United States Patent [19]

McVey

[11] Patent Number: 4,482,789

[45] Date of Patent: Nov. 13, 1984

[54] APPARATUS FOR PREVENTING UNAUTHORIZED USE OF ELECTRICALLY POWERED EQUIPMENT

[76] Inventor: Jack L. McVey, 1926 N. Sheridan, Wichita, Kans. 67203

[21] Appl. No.: 423,866

[22] Filed: Sep. 27, 1982

[51] Int. Cl.[3] ..... H01H 9/28

[52] U.S. Cl. ..... 200/44; 200/50 B; 200/51 R

[58] Field of Search ..... 200/42 R, 44, 50 B, 200/51 R

[56] References Cited

U.S. PATENT DOCUMENTS

| | | | |
|---|---|---|---|
| 1,104,093 | 7/1914 | Young et al. | 200/42 R |
| 2,470,944 | 5/1949 | Parish | 200/50 B |
| 2,856,474 | 10/1958 | Norris | 200/44 |
| 3,524,029 | 8/1970 | Laff | 200/44 |
| 3,833,779 | 9/1974 | Leone | 200/42 R |
| 4,063,110 | 12/1977 | Glick | 200/44 |
| 4,167,658 | 9/1979 | Sherman | 200/44 |

FOREIGN PATENT DOCUMENTS

| | | | |
|---|---|---|---|
| 107275 | 6/1917 | United Kingdom | 200/50 B |

*Primary Examiner*—John W. Shepperd
*Attorney, Agent, or Firm*—Robert E. Breidenthal

[57] ABSTRACT

A controlled access socket assembly wherein a locking device prevents unauthorized movement of the actuator of an electric switch that selectively connects and disconnects a source of electrical power to an electrical outlet socket adapted to receive the male plug of an electric power cord. A plug holding device is movable between positions that selectively holds and releases a power cord plug from being held in the socket. A cam is operatively associated with the switch actuator to urge the holding device to its holding position when the latter is in its plug-releasing position when the actuator is moved to cause deenergization of the socket, with the cam preventing movement of the holding device to its releasing position solely when the switch actuator has been moved to cause deenergization of the socket.

8 Claims, 10 Drawing Figures

FIG. 5
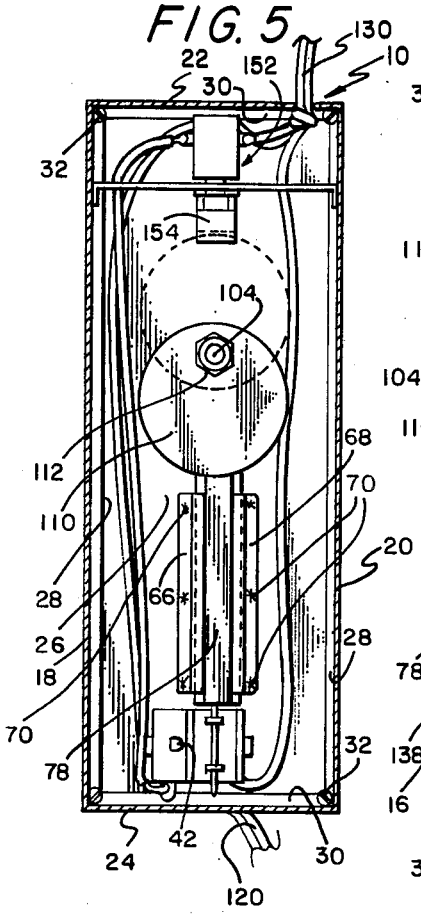
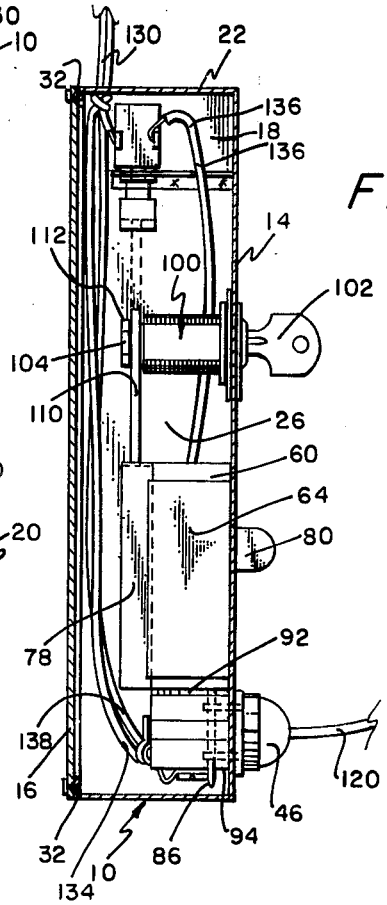
FIG. 6
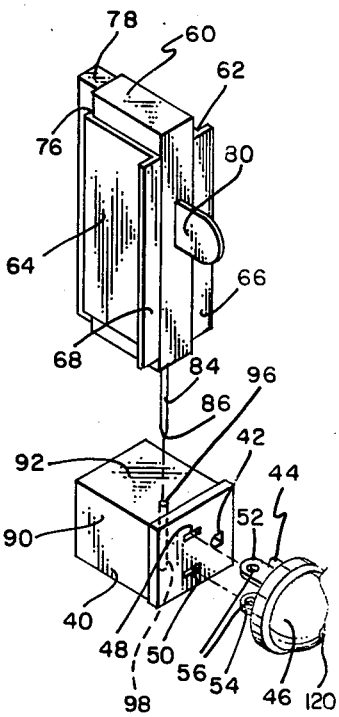
FIG. 8
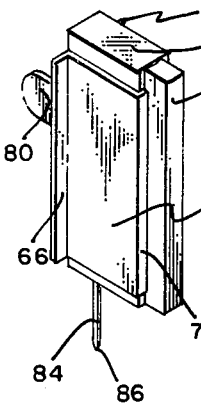
FIG. 7
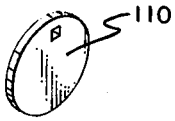
FIG. 9
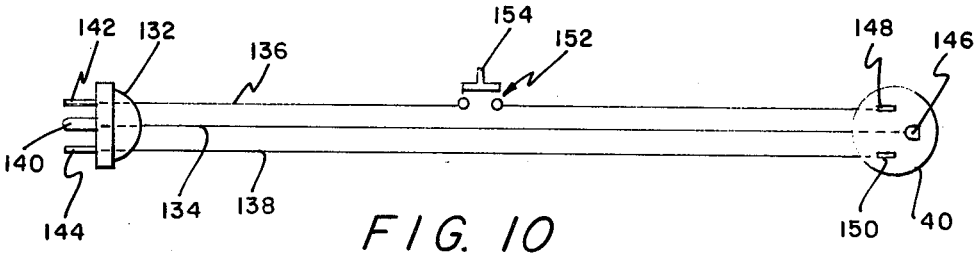
FIG. 10

APPARATUS FOR PREVENTING UNAUTHORIZED USE OF ELECTRICALLY POWERED EQUIPMENT

The present invention relates to new and useful improvements in apparatus for limiting the use of electrically powered equipment, and pertains to such apparatus wherein locking device prevents those without a key or the like from energizing an electric socket outlet, and wherein means are provided for preventing withdrawal of a power cord plug from such socket.

The following U.S. patents provide a background understanding of proposals that have heretofore been made in the general field of the subject invention: U.S. Pat. No.

3,942,856, Mindheim, deceased et al, Mar. 9, 1976
4,060,297, Marshall et al, Nov. 29, 1977
2,759,159, Tettor, Aug. 14, 1956
2,664,734, McEneaney, Jan. 5, 1954
2,552,061, Popp, May 8, 1951
2,654,073, Katz, Sept. 29, 1953

Many situations exist wherein the economic losses endured by the owners of electrically powered equipment by reason of theft of such equipment is exceeded by unauthorized use of such equipment. For example, electrically powered copying machines are often subjected to extensive unauthorized use that can be quite expensive. Such unauthorized use can occur under circumstances where usual security measures are practiced that essentially preclude theft of the machine, and involve employees or persons that do not view their acts as being in the nature of theft. Many examples of this nature could obviously be given.

It may also be that prevention of unauthorized use of electrical equipment is necessary to avoid legal liability based on negligence when bodily injury occurs during such use.

Many parents could enjoy or find adult-only type entertainment more acceptable if unapproved access or unauthorized use of television sets, video recorders, and cable TV equipment could be prevented.

The paramount objective of the present invention is to provide apparatus whereby the supply of electrical energy to the power cord of electrically powered equipment, e.g., copier, television vision set, etc., can be denied except to persons capable of operating a lock device.

Another object in accordance with the foregoing object is to sequester or hold a power cord plug against disengagement from a deenergized outlet socket when use of equipment normally powered through such cord is to be denied.

Yet another object is to enable actuation of a plug-holding device to its operative condition by structure independent of any lock device.

A broad aspect of the instant invention involves apparatus for preventing the unauthorized supply of electrical energy to an electric power cord plug, said apparatus comprising an electrical power outlet socket adapted to receive an electric power cord plug to be energized therefrom, plug-holding means movable between obstructing and nonobstructing positions and adapted in the former position to obstruct withdrawal of a power cord plug from said outlet socket, key-controlled means for selectively enabling and preventing the supply of electrical energy to the outlet socket, and security means operative to prevent movement of the plugholding means from its obstructing position when the key-controlled means prevents the supply of electrical energy to the outlet socket, whereby a power cord plug cannot be withdrawn from the outlet socket for energization elsewhere when the key-controlled means prevents energization from the outlet socket, electric circuit means adapted to be connected to electric power mains, an electric switch means for selectively electrically coupling and decoupling said circuit means from the socket whereby the socket may be selectively energized and deenergized, a switch actuator movable between on and off positions together with a lock device operatively associated therewith for preventing unauthorized movement thereof, whereby only an authorized person can selectively energize and deenergize the socket, and blocking means operatively connected to the actuator for blocking movement of the plug-holding means from its obstructing position when the actuator is in its off position, whereby a power cord plug cannot be removed from the socket when the actuator is in its off position.

Numerous other uses, objects, aspects, features and advantages of the invention will become manifest in the light of the following description of a preferred embodiment of the invention, such description being given in conjunction with the accompanying drawings illustrative thereof, wherein:

FIG. 5 is a horizontal sectional view taken on the plane of the section line 5—5 in FIG. 3, with alternate positions of the cam and the switch button being shown in dashed outline;

FIG. 6 is a vertical sectional view taken upon the plane of the section line 6—6 in FIG. 2, and shows alternate positions of the cam and the push button of the switch in dashed outline;

FIG. 7 is an isolated isometric view of the slide and guide assembly;

FIG. 8 is an exploded isometric view of the structure of FIG. 7, the socket and the power cord plug with spatial relationship of parts being shown in dashed lines;

FIG. 9 is an isometric view of the cam; and,

FIG. 10 is an electrical schematic diagram.

Figure 1:
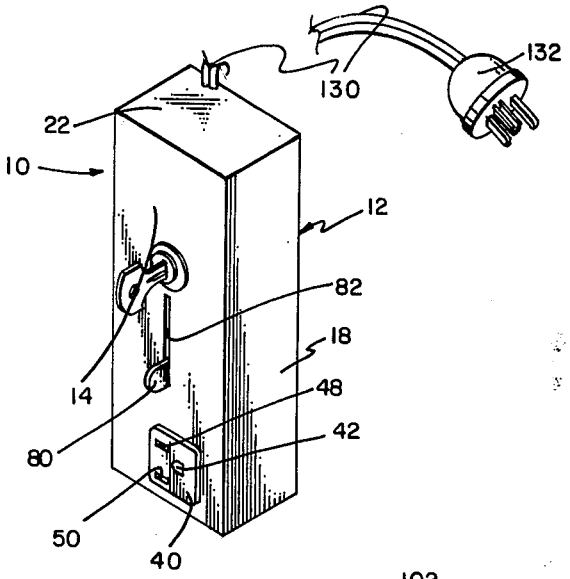
FIG. 1 is a broken isometric view of the apparatus for preventing unauthorized energization of electrical equipment.
Figure 2:
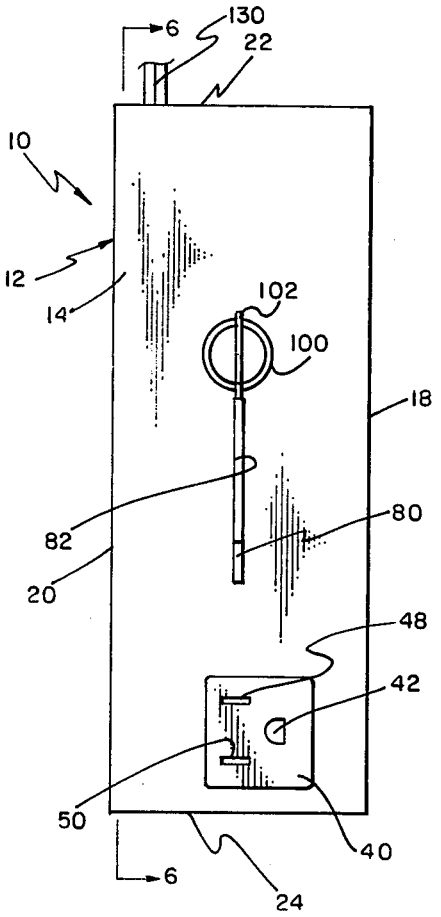
FIG. 2 is a top plan view of the apparatus with a portion of the power cord and its plug being broken away.
Figure 3:
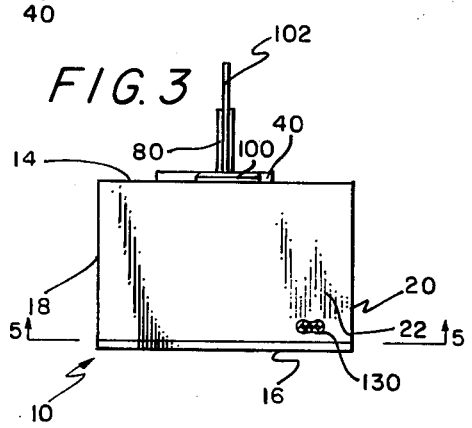
FIG. 3 is an end view of the apparatus from the supply cord end thereof with such cord being shown in section.
Figure 4:
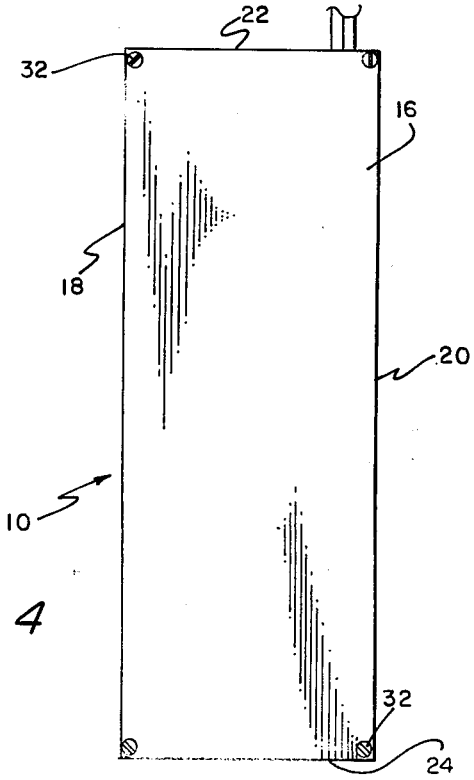
FIG. 4 is a bottom view of the structure shown in FIG. 2.

Referring now to the drawings wherein like numerals designate like parts throughout the various views, the reference numeral 10 designates generally the apparatus for preventing unauthorized energization of an electric power cord which is hereinafter referred to as the electric supply security device or simply as the security device.

The security device 10 comprises a housing 12 of an overall parallelepiped configuration constituted of rectangular and horizontally disposed top and bottom walls 14 and 16, perpendicular and rectangular side walls 18 and 20, and perpendicular and rectangular end walls 22 and 24 to define an interior or secure enclosed space 26. The housing 12 can be made of any suitable conventional material such as plastic or metal. If the housing 12 is made of plastic, the top, bottom, side and end walls can be molded to be of one-piece construction and the bottom wall can be cemented thereto when the security device 10 has otherwise been assembled. Alternately, the top, side and end walls can be conventionally fabricated from flat steel or aluminum stock by stamping and bending to the illustrated configuration of the housing 12 with inturned flanges 28 and 30 being formed at the lower edges of the side and end walls for convenient attachment of the bottom wall 16 thereto by any suitable means, such as threaded screws 32 or the like. If screws are employed, it is preferred that the kerfs thereof be selected of many types available that do not coact readily with common screwdriver tips; the purpose, of course, being to deny ready access to the space 26 by unauthorized persons. Alternatively, the bottom wall 16 can be secured to the flanges 28 and 30 by conventional pop rivets or the like.

A convenience power outlet socket 40 is mounted in the top wall 14 as shown, and the same can be of a conventional type (modified a hereinafter explained) that includes provision at 42 for receiving the ground post 44 of a conventional power cord plug 46 (see FIG. 8). Also as is conventional, the socket 40 includes conventional provisions at 48 and 50 for accommodating the conventionally apertured blades 52 and 54 of the power cord plug 46. As will become apparent, use is made of the apertures 56 in the blades 52 and 54 in holding the plug 46 against removal from or against disengagement from the socket 40.

Means are provided that are selectively operable to prevent or obstruct removal of the plug 46 from the socket 40. Such means comprises a slide 60 of a generally parallelepiped configuration that is mounted upon the underside of the housing top wall 14 for linear sliding reciprocative movement by a pair of parallelly spaced vertical guide brackets 62 and 64. The guide brackets 62 and 64 have oppositely directed flanges 66 and 68, respectively, at their upper edges that are seated against and fixed to the underside of the top wall 14 by any suitable cement or adhesive or spot welding 70. Spot welding 70 is the preferred manner of attachment when the wall 14 and the flanges 66 and 68 are steel, with a suitable cement or adhesive being well suited for such purpose when the components involved are of a suitable synthetic resin or plastic material.

The lower edges of the brackets 62 and 64 are provided with horizontally extending inturned flanges 74 and 76 respectively that slidingly support the slide 60, it being noted that the opposite sides and top of the slide 60 have free running clearance with respect to the guides 62 and 64 and the top wall 14 of the housing 12. To further assure smooth guided movement of the slide 60, the same is provided with an integral depending medial rib 78 that has free running clearance between the flanges 74 and 76.

The slide 60 is provided with an upstanding tab 80 that extends through an elongated slot 82 in the top wall 14. The slot 82 slidingly accommodates the tab 80 during reciprocating sliding movement between limiting positions respectively termed obstructing and nonobstructing positions for reasons presently to become apparent.

Suitably affixed to the slide 60 and projecting therefrom in a direction parallel to the movement of the same is an elongated element 84 of a generally circular cylindrical configuration that terminates in a tapered or pointed configuration at its free end 86. The element 84 is in alignment with the positions defined by the apertures 56 in the blades 52 and 54 of the plug 46 when the latter is inserted into or received in the socket 40 in the usual manner.

The socket 40 has thus far been described as being conventional, however, the same is modified to such extent as may be necessary to allow free movement of the element 84 into and from its structure so as to allow the element 84 to pass through the apertures 56 when the plug 46 is received in the socket 40. A conventional socket can, for example, and preferably will, include a housing such as indicated at 90, having opposite side walls 92 and 94, and in such an example, the side walls 92 and 94 are respectively provided with openings 96 and 98 that are aligned with and slidingly allow the element 84 to extend therethrough. It is preferred that the socket 40 include the walls 92 and 94 necessitating the openings 96 and 98 for the reason that such walls will serve to afford lateral support to the element 84 at positions spaced from the slide 60, when the latter extends therethrough. It will be obvious to those of ordinary skill in the art that any other structure of the socket in the path of the element can be appropriately apertured as in the case of the walls 92 and 94 so as to free the element 84 for endwise movement with the incidental benefit of lateral support therefor being realized.

As thus far described, the slide 60 can be moved to its obstructing position as shown in FIGS. 5 and 6, in which event the element 84 enters the socket 40 so as to pass through the apertures 56 of the plug 46, as well as through such other structure of the socket 40 in the path of the element 84 such as the apertured walls 92 and 94. It will be appreciated that the pointed or tapered configuration of the end portion 86 of the element 84 facilitates or guides entry of the element into the apertures 56 and openings such as the openings 96 and 98. It will be plain that movement of the slide 60 into its obstructing position can be manually effected by manipulating the tab or finger grip 80. Similarly, the tab 80 can be manipulated to move the slide 60 to its nonobstructing position such that the element 84 is withdrawn at least from the apertures 56 if not the entire socket 40.

Manifestly, the element 84 prevents or obstructs removal of the plug 46 from the socket when it extends through the apertured blades 52 and 54 thereof.

For a reason that has already been apparent, namely, the prevention of an electrical short circuit between the blades 52 and 54 of the plug 46, the element 84 is made of any suitably tough and durable material of electrically insulative character, such as, for example, nylon or a tetrafluoroethylene resin such as marketed under the trademark TEFLON by E. I. DuPont De Nemours & Co., Inc.

Key-controlled means are provided for blocking movement of the slide 60 from its obstructing position, such means comprising a conventional pin and cylinder type locking device 100 disposed in the space 26 and mounted on the top wall 14 so as to accept a key 102 in the usual manner. The lock device 100 includes a rotatable component or shaft 104 that can be rotated or turned only when the key 102 is inserted in the device 100. The arrangement is such that the component or actuator 104 can be turned from the position shown thereof only by turning the key 102 when it is inserted in the device 100 as shown.

A blocking member 110, which is indeed a cam as will be seen shortly, is fixed to the rotatable component or actuator 104 by any suitable means such as threaded means 112 so as to be disposed in the path of the slide 60 to block movement of the latter from obstructing position when the member or cam 110 is in the full line position shown thereof in FIGS. 5 and 6. The blocking member or cam 110 can be moved, on use of the key 102 to turn the actuator 104 180 degrees, to the dashed line position shown thereof in FIG. 5 such as to move out of the travel path of the slide 60, whereupon the slide 60 can be moved to its nonobstructing position by use of the tab or finger grip 80.

As thus far described the plug 46 can be inserted into the socket 40 and by use of the key 102 and the tab 80 be held against removal by any unauthorized person, namely, anyone not having the key 102 unique to the locking device 100. Under such circumstances, assuming the socket 40 to be deenergized, it would be impossible for anyone not having the appropriate key 102 to surreptitiously energize the plug 46 from some other energized socket and thus energize any electrical equipment, not shown, to which the plug 46 is connected by its associated power cord 120.

The blocking member or cam 110 is a multifunction device in that its configuration is such that it will contact the end of the slide 60 remote from the element 84, and by cam action force the latter to move from its nonobstructing position to its obstructing position when the key 102 and the actuator 104 are turned to rotate the cam 110 from its dashed to its full line blocking position as shown in FIG. 5. Such camming action need not impose a torque load on the key 102 if desired as the tab 80 can be used to effect the slide 60 movement before turning the key 102.

The cam 110 performs yet another camming function having to do with energization and deenergization of the socket 40 as will now be explained.

Electric circuit means are provided for energizing the socket that includes an electrical power cord 130 extending from within the housing 12 to terminate in a conventional power cord plug 132. The power cord 130 is for safety reasons preferably of the type that includes a ground wire 134 in addition to the usual pair of power conductors 136 and 138. The ground wire 134 is connected to a ground post 140 of the plug 132 and the conductors 136 and 138 are respectfully connected to the blades 142 and 144 of the plug 132. Within the housing 12, the ground wire 134 is extended to and is electrically and mechanically connected in a conventional manner to the ground terminal contactor 146 of the socket 40. In a similar fashion, the power conductors 136 and 138 are mechanically and electrically connected to the conventional internal contactors 148 and 150 of the socket 40.

An electrical switch means 152 within the space 26 is electrically interposed in the power conductor 136 to prevent effective electrical energization of the socket 40 from the power cord 130 and its plug 132. The electric switch means is a conventional normally-open, push-button electric switch. The switch 152 includes a spring-biased push button 154 that is operative upon being depressed or pushed inwardly to close the switch electrically, with the switch 152 opening upon the push button 154 being freed of the depressing force.

The push button 154 of the switch 152 is disposed in the travel path of the eccentrically mounted, essentially circular cam 110 at a position diametrically opposed to that of the slide 60 relative to the rotatable actuator 104 so that the push button 154 is free and the switch 152 open and the socket 40 therefore deenergized when the cam 110 is in its blocking position shown in full lines in FIG. 5.

When the key 102 is used to turn the actuator 104 and the cam 110 180° to the positions shown thereof in dashed outline in FIG. 5, the cam 110 contacts and cams the push button 154 to its depressed position closing the switch 152. This in turn serves to energize the contactors 148 and 150 of the socket 40 wherefrom the blades 52 and 54 of the plug 46 are energized when the latter is plugged into the socket 40.

It will be noted that movement of the cam 110 from its blocking position to its switch closing position does not cause the slide to be moved to its nonobstructing position. Such a provision to accomplish such function could easily be accomplished by those of very modest skill and only slight familiarity with the art, however, such an easily attainable function is not preferred as will now be made evident.

Ordinarily electrical equipment has its power supply cord coupled to a convenience outlet or socket for very protracted times and the same will also be true in using the apparatus of the present invention. In other words, it will only be rarely necessary that the slide 60 be moved to its unblocking position, and it would amount to unnecessary and wasted effort to move the slide 60 to its unblocking position every time an authorized person is present or the socket 40 is energized. Indeed it is ordinarily advantageous that the slide 60 be in or remain in obstructing position even when the socket 40 is energized as such will prevent inadvertent dislodgment or pulling of the plug 46 from the socket 40. It is a simple enough matter to use the tab 80 to move the slide 60 to its nonobstructing position on the relatively infrequent occasions that the plug 46 is to be inserted into or removed from the socket 40.

It will be understood that the lock device 100 can be of the type such that the key 102 can be inserted into or removed therefrom only when the cam 110 is in its blocking position. However, if desired or deemed expedient, the lock device 100 can be such that the key 102 can also be inserted and removed when the cam 110 is in its switch closing position, that is, the key 102 can be inserted or removed at positions 180° apart from each other. The latter mentioned lock device 100 is preferred for the reason that the key 102 itself is not needlessly exposed to theft merely by someone turning the key 102 of an energized device 10 and removing the same.

As the invention is readily susceptible to numerous variations without departing from the spirit thereof such as by mounting the housing 12 on a wall so as to dispense with a power supply cord therefor, attention is directed to the appended claims in order to ascertain the actual scope of the invention.

I claim:

1. In apparatus for preventing the unauthorized supply of electrical energy to an electric power cord plug, said apparatus comprising an electrical power outlet socket adapted to receive an electrical power cord plug to be energized therefrom, plug-holding means freely movable between obstructing and non-obstructing positions and adapted in the former position to obstruct withdrawal of a power cord plug from said outlet, key-controlled means inclusive of a cam movable between on and off positions for respectively enabling and preventing the supply of electrical energy to the outlet socket, with said cam being respectively disposed in positions that allow and prevent movement of the plug-holding means from its obstructing position when the key-controlled means is in its off position, whereby a power cord plug cannot be withdrawn from the outlet socket for energization elsewhere when the key-operated means is in its on and off positions to prevent energization of the socket, and whereby only an authorized person can selectively turn the key-controlled means to its on position, and a finger tab connected to the plug-holding means for enabling movement of the latter between its obstructing and non-obstructing positions when the key-controlled means is in its position, said plug-holding means being mounted for rectilinear movement between its said positions and including an elongated pin aligned with such movement, with said pin being adapted to extend through at least one apertured blade of a plug received in the socket.

2. In apparatus for preventing the unauthorized supply of electrical energy to an electrical power cord plug, said apparatus comprising an electrical power outlet socket adapted to receive an electrical power cord plug to be energized therefrom, plug-holding means freely movable between obstructing and non-obstructing positions and adapted in the former position to obstruct withdrawal of a power cord plug from said outlet socket, key-controlled means inclusive of a cam movable between on and off positions for respectively enabling and preventing the supply of electrical energy to the outlet socket, with said cam being respectively disposed in positions that allow and prevent movement of the plug-holding means from its obstructing position when the key-controlled means is in its on and off positions, whereby a power cord plug cannot be withdrawn from the outlet socket for energization elsewhere when the key-operated means is in its off position to prevent energization of the socket, and whereby only an authorized person can selectively turn the key-controlled means to its on position, a finger tab connected to the plug holding means for enabling movement of the latter between its obstructing and non-obstructing positions when the key-controlled means is in its on position, said cam being operative to cam the plug-holding means toward its obstructing position upon the key-controlled means being moved from its on to its off position, said security means and the plug-holding means being so constructed and arranged that the latter can be freely moved between its obstructing and non-obstructing positions when the key-controlled means is in its on position, a housing preventing access to the structure thus far recited such that would enable an unauthorized person to remove a power cord plug from the socket when the key-controlled means is in its off position, said housing having an elongated opening therethrough, with said finger tab extending through the opening to the exterior of the housing in a direction normal to the direction of movement of the plug-holding means, whereby the plug-holding means can be manually moved freely from either of its positions to the other from the exterior of the housing when the key-controlled means is in its on position.

3. In apparatus for preventing the unauthorized supply of electrical energy to an electrical power cord plug, said apparatus comprising an electrical power outlet socket having electrical contacts adapted to be engaged by the blades of an electric power cord plug inserted in such socket, plug-holding means freely and rectilinearly movable along a path between obstructing and non-obstructing positions and adapted in the former position to obstruct withdrawal of a power cord plug from said outlet socket, said plug-holding means being separate from and movable relative to the socket contacts, key-controlled means for selectively enabling and preventing the supply of electrical energy to the outlet socket, said key-controlled means including a switch actuator movable between on and off positions together with a lock device operatively connected thereto for preventing unauthorized movement thereof, said key-controlled means also including an electric switch with the actuator being operatively associated with the latter so that the switch is closed and open when the actuator is respectively in its on and off positions, with said actuator being disposed in a position spaced from the socket and in the path of the plug-holding means to prevent movement of the plug-holding means toward its nonobstructing position when the actuator is in its off position.

4. The combination of claim 3, wherein said actuator is inoperative to prevent free movement of the plug-holding means between its positions when the key-controlled means enables the supply of electrical energy to the contacts of the outlet socket.

5. The combination of claim 4, together with a housing, said plug-holding means being disposed within the housing, and means manually operable from the exterior of the housing for moving the plug-holding means between its positions when the actuator is inoperative to prevent movement of the plug-holding means from its obstructing position toward its nonobstructing position, whereby the plug-holding means can be freely moved selectively to hold or release a plug.

6. The combination of claim 4, wherein said actuator is a cam means operable to urge the plug-holding means from its nonobstructing position to its obstructing position when in the former position as the actuator is from its on to its off position.

7. The combination of claim 6, wherein said key-controlled means includes a normally open push-button electric switch operatively associated with the cam means so that the switch is closed by cam action as the cam means moves from its off position in the path of the plug-holding means to its on position closing the switch.

8. In apparatus for preventing the unauthorized supply of electrical energy to an electrical power cord plug, said apparatus comprising an electrical power outlet socket adapted to receive an electric power cord plug to be energized therefrom, said socket including electrical contacts adapted to be engaged by the blades of a plug received in the socket, plug-holding means movable relative to the contacts and between obstructing and nonobstructing positions and being adapted in the former position to obstruct withdrawal of a power cord plug from said outlet socket, key-controlled means for selectively enabling and preventing the supply of electrical energy to the contacts of the outlet socket, the key-controlled means being additionally operative to prevent rectilinear movement of the plug-holding means toward its nonobstructing position when the key-controlled means prevents the supply of electrical energy to the contacts of the outlet socket, whereby a power cord plug cannot be withdrawn from the outlet socket for energization elsewhere when the key-controlled means prevents energization from the outlet socket.

* * * * *